United States Patent [19]

Krasznai et al.

[11] Patent Number: 4,951,348

[45] Date of Patent: Aug. 28, 1990

[54] ROTATABLE INDEXABLE ACCESSORY VACUUM CLEANER TOOL

[75] Inventors: Charles Z. Krasznai, Trumbull; Richard B. Kosten, West Haven, both of Conn.; Ron Barker, Brewster, N.Y.; Burton E. Gerke, Jr., Newtown, Conn.

[73] Assignee: Black & Decker Inc., Newark, Del.

[21] Appl. No.: 294,614

[22] Filed: Jan. 9, 1989

[51] Int. Cl.[5] ..... A47L 5/24

[52] U.S. Cl. ..... 15/414; 15/395; 15/415.1

[58] Field of Search ..... 15/414, 416, 417, 415 R, 15/395

[56] References Cited

U.S. PATENT DOCUMENTS

| | | | |
|---|---|---|---|
| 1,847,696 | 3/1932 | Nielsen | 15/338 |
| 2,844,841 | 7/1958 | Bergquist | 15/417 |
| 4,573,237 | 3/1986 | Kochte et al. | 15/414 X |
| 4,766,638 | 8/1988 | McDowell | 15/410 X |

FOREIGN PATENT DOCUMENTS

| | | | |
|---|---|---|---|
| 371531 | 4/1932 | United Kingdom | 15/414 |

*Primary Examiner*—Chris K. Moore

*Attorney, Agent, or Firm*—Barry E. Deutsch

[57] ABSTRACT

An accessory crevice tool for a hand vacuum cleaner includes a stationary portion having an adapter fittable into an inlet opening in the dust bowl of the hand-held vacuum cleaner and a rotatable portion fitted thereon. Detents in the connection between the stationary portion and the rotatable portion of the crevice tool permit stable retention of the crevice tool in a desired rotational position. A spring clip can be positioned in the inlet opening for engagement with a surface of the adapter. A locking portion of the spring clip can extend into the inlet opening for engagement with an optional latching groove in the surface of the adapter. This engagement retains the crevice tool attached to the dust bowl against all but affirmative effort to disengage them.

11 Claims, 4 Drawing Sheets

FIG.6
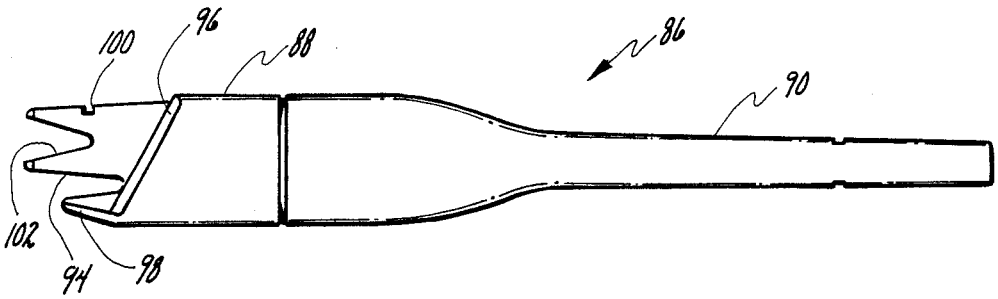
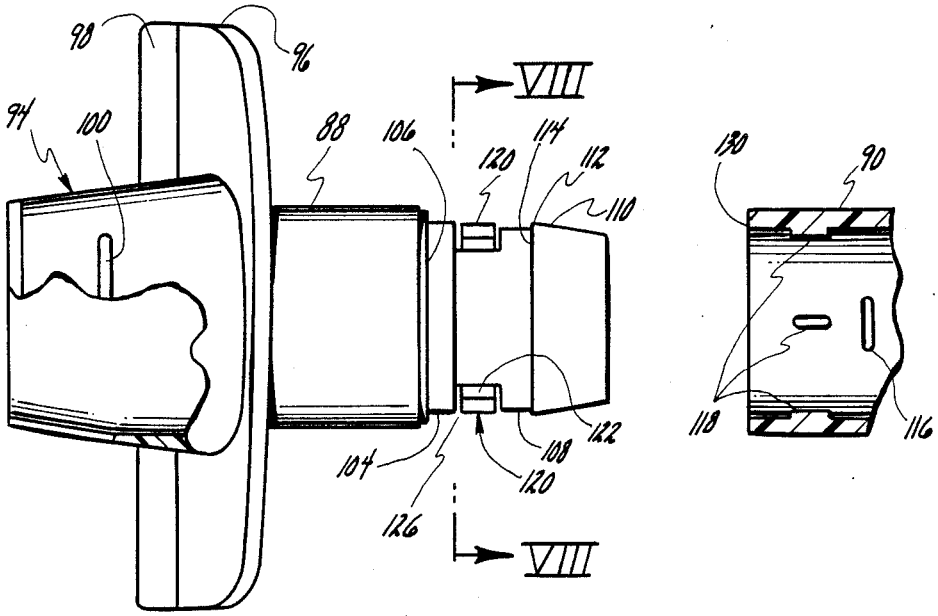
FIG. 7
FIG.8
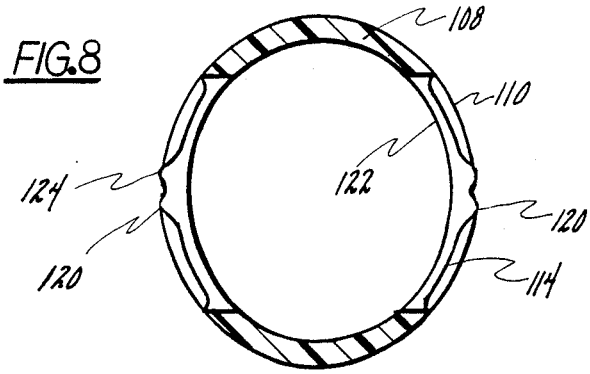

ROTATABLE INDEXABLE ACCESSORY VACUUM CLEANER TOOL

BACKGROUND OF THE INVENTION

This invention relates to portable vacuum cleaners and, more particularly, to accessories such as crevice tools for use with portable vacuum cleaners.

Crevice tools are conventionally used with vacuum cleaners to clean narrow regions such as, for example, spaces behind sofa cushions, which may be difficult, if not impossible to reach in any other convenient way. Crevice tools are most commonly used with externally powered vacuum cleaners having a flexible hose to which various accessories such as, for example, floor tools, may be attached. When it is desired to clean a crevice, a crevice tool is affixed to the end of the flexible hose. The flexibility of the flexible hose permits rotation of the crevice tool as necessary to align the long axis of the suction opening of the crevice tool with the axis of the crevice to be cleaned.

A hand-held, optionally internally powered vacuum cleaner is known. Lacking a flexible hose between the suction portion of the vacuum cleaner and the suction opening thereof, the entire vacuum cleaner may have to be turned to align the vacuum cleaner itself with the crevice to be cleaned. This could prove awkward to the user.

OBJECTS AND SUMMARY OF THE INVENTION

It is an object of the invention to enable a hand-held vacuum cleaner to overcome the drawbacks of the prior art.

It is a further object of the present invention to provide an accessory tool for a vacuum cleaner that permits mating of the accessory tool directly to the dust bowl of the vacuum cleaner.

It is a still further object of the invention to provide an accessory crevice tool for a hand-held vacuum cleaner which includes means for permitting rotation of the end of the crevice tool, and an indexing device for retaining the crevice tool in a desired one of a plurality of different rotational positions.

It is still further object of the invention to provide an accessory crevice tool for a portable vacuum cleaner wherein the crevice tool includes an adapter fittable into an air inlet opening of the vacuum cleaner for providing suction from the end of the air opening to the end of the accessory crevice tool.

It is still further object of the invention to provide an accessory crevice tool having a stationary portion with an adapter fittable into the air opening of a hand-held vacuum cleaner, and a rotatable portion mounted thereon. A spring retainer, dependent within the air opening, can be provided to engage the adapter. In addition, a shallow groove can be provided in the adapter engageable by the spring retainer for removably retaining the adapter in place.

Briefly stated, the present invention provides an accessory tool for a hand-held vacuum cleaner which includes a stationary portion and a rotatable portion rotatably fitted thereto. The stationary portion includes an adapter fittable into the inlet opening in the dust bowl of the hand-held vacuum cleaner. Detents are provided in the connection between the stationary portion including the adapter, and the rotatable portion of the crevice tool, which permit stable retention of the crevice tool in a desired rotational position.

In the combination of the accessary tool with a hand-held vacuum cleaner, a spring clip is mounted into the inlet opening. A locking portion of the spring clip extends into the opening for frictional engagement with the surface of the adapter or latches into a detent groove therein to retain the crevice tool within the opening against all but affirmative effort to remove it.

According to an embodiment of the invention, there is provided an accessory tool for a vacuum cleaner which has an inlet opening, the accessory tool comprising a stationary portion, a rotatable portion, an adapter on the stationary portion, the adapter being fittable in the inlet opening, and means for engaging the stationary portion and the rotatable portion together while permitting relative rotation therebetween and providing indexing at specific relative positions.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 6 is a cross section taken along lines VI—VI in FIG. 5.

DETAILED DESCRIPTION OF THE PREFERRED EMBODIMENT

Figure 1:
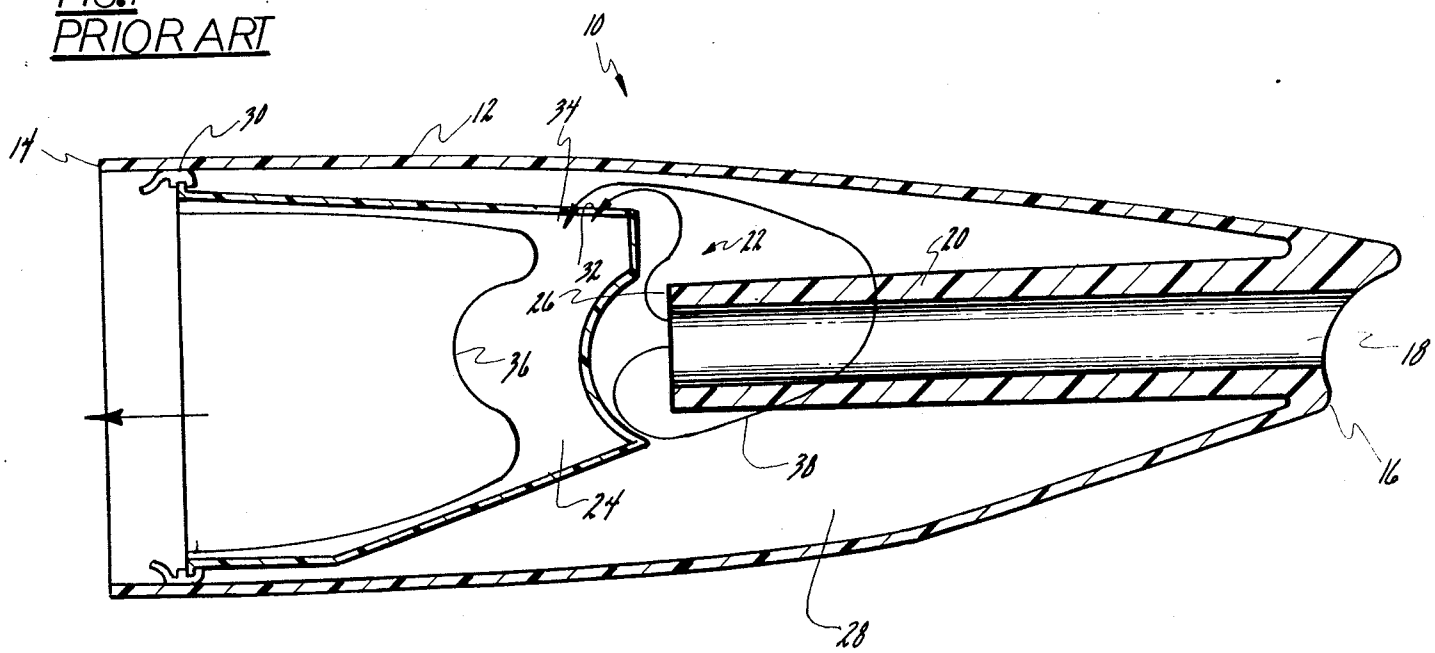
FIG. 1 PRIOR ART
FIG. 1 is a cross section of a dust bowl of a wet-dry vacuum cleaner according to an embodiment of the invention.

The crevice tool of the present invention could be used in any type of hand-held vacuum cleaner including one adapted for picking up dry soil only or one adapted for picking up dry soil and/or liquid. For concreteness, however, the crevice tool of the present invention is described in the environment of a wet-dry vacuum cleaner. Referring to FIG. 1, a forward portion of a dust bowl 10 of a wet-dry vacuum cleaner is shown. It will be understood that dust bowl 10 is adapted for installation on a vacuum cleaner power unit (not shown) which develops a partial vacuum, thereby drawing air and entrapped soil and moisture thereto.

The dust bowl 10 includes a housing 12 having a rearward end adapted, in known fashion, for attachment to the vacuum cleaner power unit. A forward snout 14 of the housing 12 includes an inlet opening 18 of an inlet chute 20. A liquid deflector, shown generally at 22 is provided to prevent liquid from directly entering the power unit. A liquid storage region 24 is disposed below inlet chute 20 to retain condensed liquid which may enter inlet chute 20 along with air and soil. An air opening is provided in liquid deflector 22 at a position to avoid entrainment of liquid from region 24. A filter (not shown) is disposed between liquid deflector 22 and the power unit to permit air to pass therethrough toward the vacuum cleaner power unit, but to prevent the passage of soil. The forward snout 14 includes an inlet socket 26 therein. The inlet chute 20 is sealingly fitted into the inlet socket 26. Inlet chute 20 includes the inlet opening 18. An inner end of the inlet chute 20 faces the liquid deflector 22 for encouraging the precipitation of liquid from the air stream passing therethrough.

Figure 2:
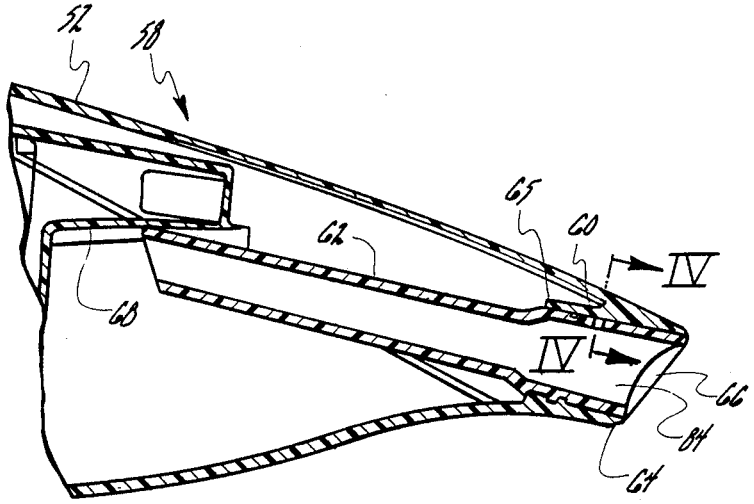
FIG. 2 is a cross section taken along lines II—II in FIG. 1.

Referring to FIG. 2, a resilient element is provided in the inlet opening. More specifically, a spring clip 30 is disposed in a slot 32 in inlet chute 20 with a middle portion 34 thereof extending a short distance radially into the inlet opening 18. End portions 36 of the spring clip 30 fit into slots 38 in the outer surface of the inlet chute 20. The end portions 36 are retained in the slots 38 by inlet socket 26 which overlies them in the illustrated assembled condition.

Figure 3:
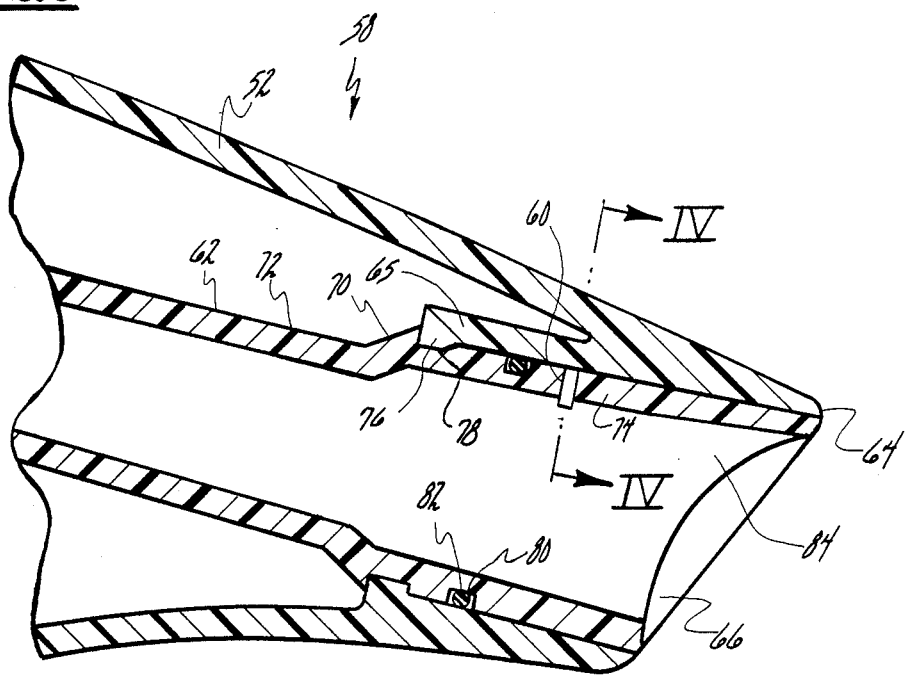
FIG. 3 is a perspective view of a dust bowl having an accessory crevice tool of the present invention installed therein.

Referring now to FIG. 3, a rotatable accessory crevice tool 40 according to the present invention is shown installed in dust bowl 10. The crevice tool 40 includes a stationary portion 42 mounted, in a manner to be described, in the forward snout 14 and a rotatable portion 44 rotatably supported by stationary portion 42. Rotatable portion 44 is free to rotate in either direction about its longitudinal axis as indicated by a double headed curved arrow 46.

Figure 4:
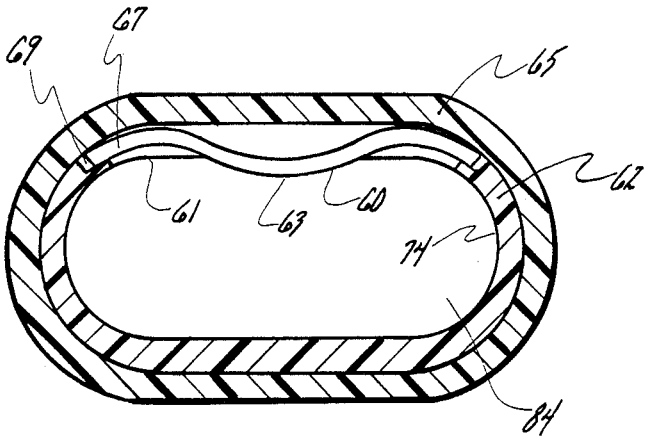
FIG. 4 is a side view of the accessory crevice tool of FIG. 3 removed from the dust bowl.

Referring now to FIG. 4, the stationary portion 42 includes an adapter 50, shaped to fit into the inlet opening 18 (FIGS. 1 and 2). A flange 52 limits the depth of insertion of adapter 50 into the inlet opening 18, and its contact with forward snout 14 tends to improve an air and liquid seal. A Vee notch 54 in each side of adapter 50 enhances the resilience of adapter 50, so that a resiliently urged fit between adapter 50 and the inlet opening 18 can provide a substantial seal at that location.

In the combination of the accessory tool 40 with the hand-held vacuum cleaner, the spring clip 30 is a means for retaining the adapter 50 in the inlet opening 18. That is, the adapter 50 is held firmly in the inlet opening 18 by the biasing of the spring clip 30 against one surface of the adapter 50.

Optionally, a latch groove 56 can be provided in the adapter to be engaged by the middle portion 34 of the spring clip 30 for more firmly retaining adapter 50 in the installed position. Firm outward force is sufficient to remove adapter 50 from the inlet opening 18.

Figure 5:
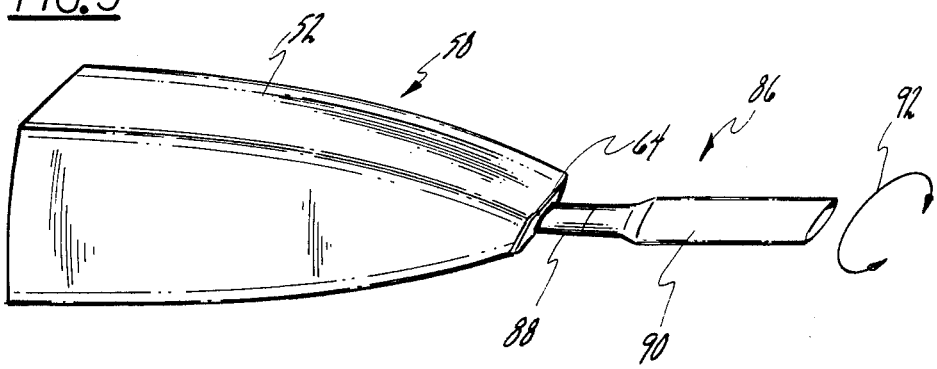
FIG. 5 is a side view, partly in cross section, of the two elements of the accessory crevice tool disassembled for purposes of description.
Figure 1:
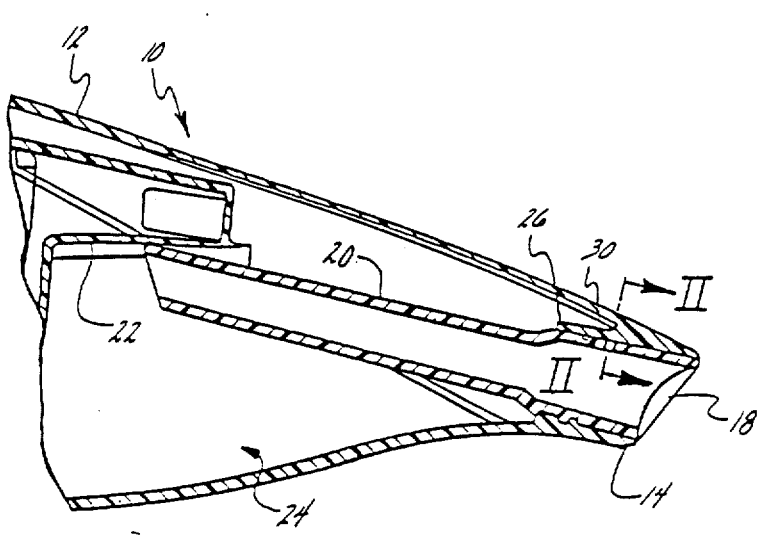
Figure 2:
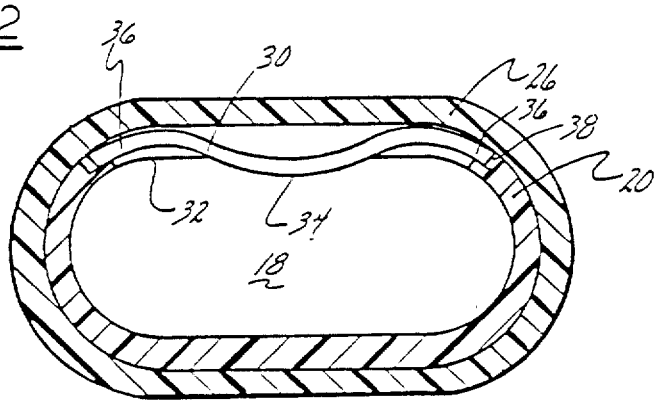
Figure 3:
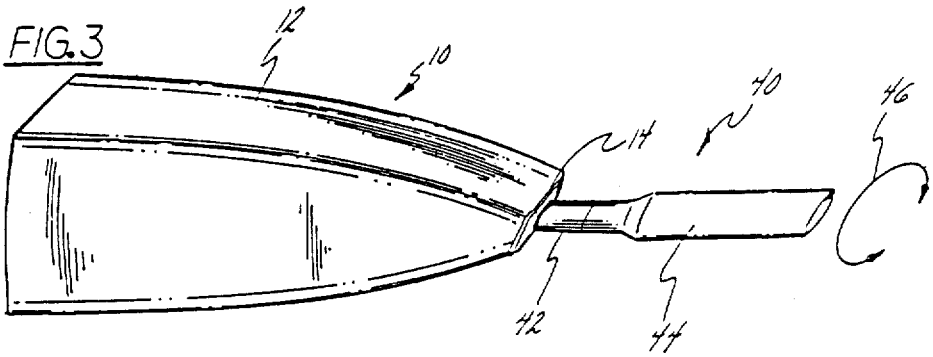
Figure 4:
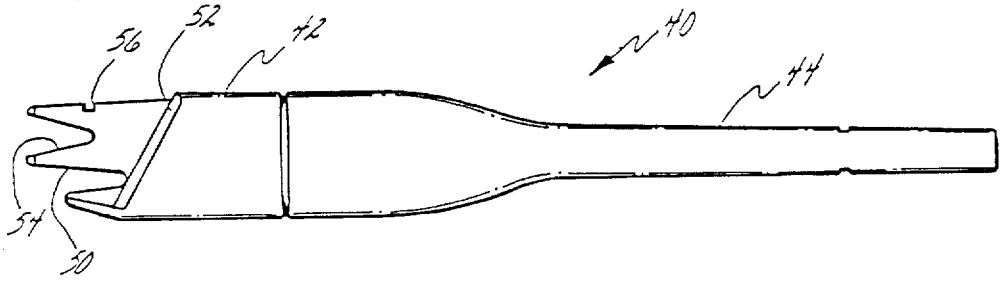

Referring now to FIG. 5, rotatable portion 44 and stationary portion 42 are shown before assembly. Means are provided on the stationary portion 42 and the rotatable portion 44 for engaging them together while permitting rotation and providing indexing at specific relative positions. A collar 64 formed on the stationary portion 42 has a reduced diameter compared to the adjacent portion of stationary portion 42, thereby forming an abutment shoulder 66. An intermediate portion 68, of smaller diameter than the collar 64, joins the collar 64 to an end portion 70 which is tapered. A maximum-diameter portion 72 of the end portion 70 forms a square shoulder 74 with the intermediate portion 68.

Rotatable portion 44 includes, on its inner surface, at least one retaining boss 76 disposed with its long axis at right angles to a longitudinal axis of rotatable portion 44, and a plurality of detent bosses 78, disposed with their long axes parallel to the longitudinal axis of rotatable portion 44.

Referring now to FIG. 6, at least one, and preferably two, detent notches 80 are supported in the intermediate section 68 each on a pair of thinned sections 82. The thinned sections 82 provide a means for providing radial resiliency to the associated detent notch 80. Tips 84 of teeth 86 which define the detent notches 80 extend outward beyond the radius of the end portion 70 and to a radius about equal to that of the collar 64 (FIG. 5). Each detent notch 80, and its associated thinned sections 82 are axially separated from the abutment shoulder 66 and the remainder of the intermediate portion 68 by a slot 88 at each side thereof to permit inward flex of the teeth 86 and, thus, provide radial resiliency to the detent notch 80 (FIG. 5).

Assembly of the rotatable portion 44 and the stationary portion 42 is performed by urging the rotatable portion 44 over the end portion 70 until the retaining boss 76 passes square shoulder 74. At this time, an end 79 of rotatable portion 44 is at, or close to, abutment with abutment shoulder 66. An inside diameter of a portion of rotatable portion 44 adjacent the end 79 is a close fit to the diameter of collar 64, whereby a relatively air-tight and liquid-tight rotatable connection is formed. Thereafter, retaining boss 76 retains rotatable portion 44 assembled to stationary portion 42, thereby engaging them together while permitting rotation. In one embodiment, the fit of retaining boss 76 behind square shoulder 74 is sufficient to prevent removal of rotatable portion 44 from stationary portion 42. However, if desired removal can be enabled by a looser fit.

Detent bosses 78, extending inward from rotatable portion 44, engage the detent notches 80 at selected rotational detent positions of rotatable portion 44 thus constituting means for providing at least one detent position wherein a stable rotational position is retained until overcome by purposeful mechanical action by a user. In the embodiment shown with four detent bosses 78 (one detent boss 78 is not shown in the cross section of FIG. 5), the detent bosses 78 engage the detent notches 80 at four rotational positions of rotatable portion 44. With this engagement, a stable rotational position is retained against all but purposeful torque applied to rotate rotatable portion 44, thereby accomplishing indexing at specific relative positions.

Instead of providing four rotational detent positions, more or less detent positions may be provided by a suitable change in the number of detent bosses 78 and/or detent notches 80. Further, plural retaining bosses 76 can be utilized. For example, four hemispherical retaining bosses can be equally spaced about the inner surface of the rotatable portion 44 positioned to engage with the square shoulder 74. In the same manner, the detent bosses can be of any suitable shape, so long as they are engageable with the detent notches to establish the selected rotational detent positions of the rotatable portion. In fact, the detent bosses can be in the form of three equi-spaced sector-shaped lands extending radially inward of the inner surface of the rotatable portion to be engaged by the detent notches. One skilled in the art, with the present specification for reference, would be fully informed by the foregoing about how to achieve any desired number and placement of detent positions.

Although the present invention is especially useful in connection with a crevice tool, one skilled in the art must recognize that the installation and rotatable features of the present invention could be adapted to other types of accessory tools. For example, a suction head (not shown), other than a crevice tool, could be mounted to a hand-held vacuum cleaner using the techniques described above. In addition, such a suction head could be made rotatable into detented positions in the manner described above with fully useful results. Such other accessory tools must be considered to fall within the spirit and scope of the invention.

Having described a preferred embodiment of the invention with reference to the accompanying drawings, it is to be understood that the invention is not limited to this precise embodiment, and that various changes and modifications may be effected therein by one skilled in the art without departing from the scope or spirit of the invention as defined in the appended claims.

What is claimed is:

1. An accessory tool for a vacuum cleaner which has an inlet opening, said accessory tool comprising:

a stationary portion;

a rotatable portion;

an adapter on said stationary portion;

said adapter being fittable into said inlet opening; and means for engaging said stationary portion and said rotatable portion together while permitting relative rotation therebetween and further including indexing means for maintaining said stationary portion and said rotatable portion in specific relative positions.

2. Apparatus according to claim 1, wherein said accessory tool is a crevice tool.

3. Apparatus according to claim 1, wherein said means for indexing includes means for providing at least one detent position wherein a stable rotational position is retained until overcome by purposeful mechanical action by a user.

4. Apparatus according to claim 1, wherein said means for indexing includes:

at least one detent notch in one of said stationary and said rotatable portions;

at least one detent boss in the other of said stationary and said rotatable portions;

means for providing resiliency to one of said detent notch and said detent boss;

said at least one detent boss engaging said at least one detent notch in at least one rotational position of said rotatable portion; and said means for providing resiliency being effective for retaining engagement between said at least one detent boss and said at least one detent notch against all but said purposeful mechanical action.

5. Apparatus according to claim 4, wherein said means for indexing includes:

an end portion at an end of said stationary portion opposite said adapter;

said rotatable portion being fittable over said end portion;

an inner end of said end portion terminating in a substantially square shoulder;

at least one retaining boss on an inner surface of said rotatable portion; and said retaining boss passing over said end portion and engaging said substantially square shoulder, whereby parting of said stationary portion and said rotatable portion is resisted while relative rotation is permitted.

6. Apparatus according to claim 1, wherein said means for indexing includes:

an end portion at an end of said stationary portion opposite said adapter;

said rotatable portion being fittable over said end portion;

an inner end of said end portion terminating in a substantially square shoulder;

at least one retaining boss on an inner surface of said rotatable portion; and said retaining boss passing over said end portion and engaging said substantially square shoulder, whereby parting of said stationary portion and said rotatable portion is resisted while relative rotation is permitted.

7. Apparatus according to claim 1, wherein:

said accessory tool further includes a flange adjacent said adapter; and said flange being brought into abutment with a periphery of said inlet opening when said adapter is installed in said inlet opening.

8. An accessory tool in combination with a hand-held vacuum cleaner, said vacuum cleaner including a housing having an inlet opening;

said accessory tool including:

a stationary portion;

a rotatable portion;

an adapter on said stationary portion;

said adapter being fittable into said inlet opening; and means for engaging said stationary portion and said rotatable portion together while permitting relative rotation therebetween and further including indexing means for maintaining said stationary portion and said rotatable portion in specific relative positions; and said vacuum cleaner further including means for retaining said adapter in said inlet opening.

9. Apparatus according to claim 8, wherein:

said means for retaining includes a resilient element in said inlet opening for engaging a surface of said adapter.

10. Apparatus according to claim 9, wherein:

said means for retaining further includes a latch groove in said surface of said adapter engaged by said resilient element when said adapter is installed in said inlet opening.

11. Apparatus according to claim 10, wherein:

said resilient element includes a detent spring; and said detent spring including a locking middle portion extending at least partly into said inlet opening.

* * * * *

UNITED STATES PATENT AND TRADEMARK OFFICE

CERTIFICATE OF CORRECTION

PATENT NO. : 4,951,348

DATED : August 28, 1990

INVENTOR(S) : Charles Z. Krasznai et al

It is certified that error appears in the above-indentified patent and that said Letters Patent is hereby corrected as shown below:

The title page showing the illustrative figure should be deleted to appear as per attached title page.

In the drawings Figs. 1, 2, 3, 4, 5 and 6 should be deleted and therefore substitute the sheets of drawings consisting of the corrected Figs. 1, 2, 3, 4, 5, and 6, as shown on the attached pages.

Signed and Sealed this

Twenty-eighth Day of September, 1993

Bruce Lehman

*Attest:*

BRUCE LEHMAN

*Attesting Officer*

*Commissioner of Patents and Trademarks*

United States Patent [19]

Krasznai et al.

[11] Patent Number: 4,951,348

[45] Date of Patent: Aug. 28, 1990

[54] ROTATABLE INDEXABLE ACCESSORY VACUUM CLEANER TOOL

[75] Inventors: Charles Z. Krasznai, Trumbull; Richard B. Kosten, West Haven, both of Conn.; Ron Barker, Brewster, N.Y.; Burton E. Gerke, Jr., Newtown, Conn.

[73] Assignee: Black & Decker Inc., Newark, Del.

[21] Appl. No.: 294,614

[22] Filed: Jan. 9, 1989

[51] Int. Cl.[5] ..... A47L 5/24

[52] U.S. Cl. ..... 15/414; 15/395; 15/415.1

[58] Field of Search ..... 15/414, 416, 417, 415 R, 15/395

[56] References Cited

U.S. PATENT DOCUMENTS

| | | | |
|---|---|---|---|
| 1,847,696 | 3/1932 | Nielsen | 15/338 |
| 2,844,841 | 7/1958 | Bergquist | 15/417 |
| 4,573,237 | 3/1986 | Kochte et al. | 15/414 X |
| 4,766,638 | 8/1988 | McDowell | 15/410 X |

FOREIGN PATENT DOCUMENTS

| | | | |
|---|---|---|---|
| 371531 | 4/1932 | United Kingdom | 15/414 |

*Primary Examiner*—Chris K. Moore

*Attorney, Agent, or Firm*—Barry E. Deutsch

[57] ABSTRACT

An accessory crevice tool for a hand vacuum cleaner includes a stationary portion having an adapter fittable into an inlet opening in the dust bowl of the hand-held vacuum cleaner and a rotatable portion fitted thereon. Detents in the connection between the stationary portion and the rotatable portion of the crevice tool permit stable retention of the crevice tool in a desired rotational position. A spring clip can be positioned in the inlet opening for engagement with a surface of the adapter. A locking portion of the spring clip can extend into the inlet opening for engagement with an optional latching groove in the surface of the adapter. This engagement retains the crevice tool attached to the dust bowl against all but affirmative effort to disengage them.

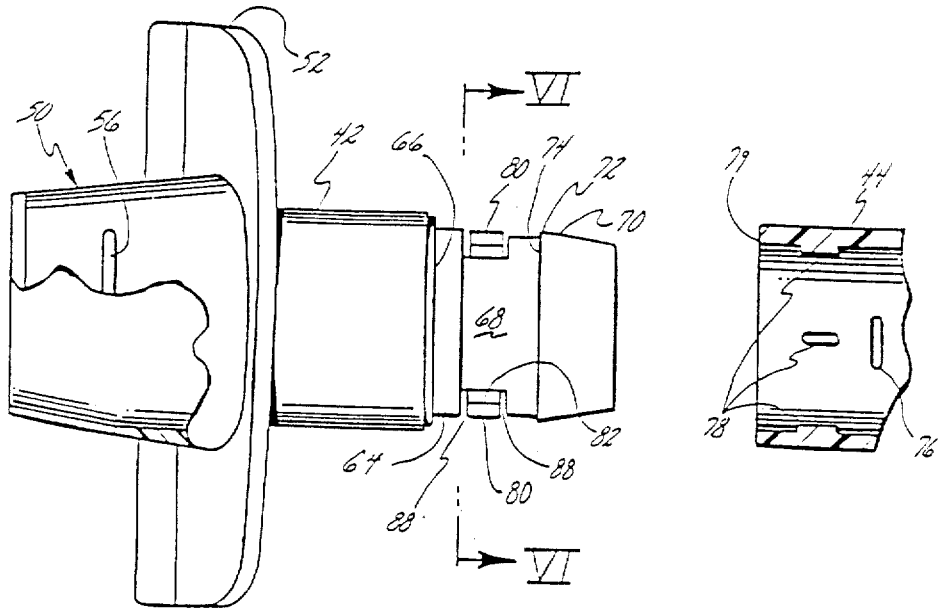

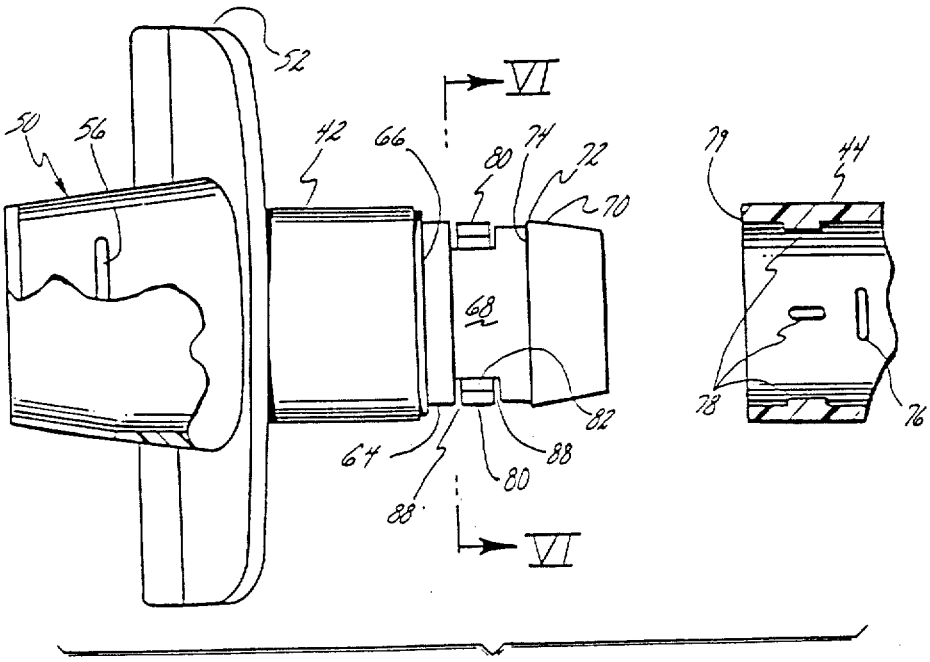
FIG.5
FIG.6
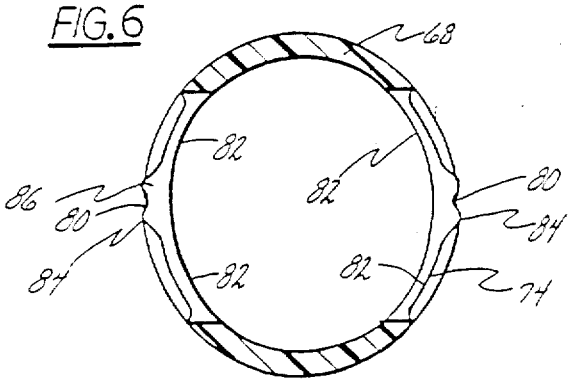

11 Claims, 4 Drawing Sheets